US011451892B2

(12) United States Patent
Wen et al.

(10) Patent No.: US 11,451,892 B2
(45) Date of Patent: Sep. 20, 2022

(54) ONE-PIECE SPEAKER HAVING BUILT-IN SOUND CAVITY

(71) Applicant: Transound Electronics Co., Ltd., Dongguan (CN)

(72) Inventors: Tseng-Feng Wen, Dongguan (CN); Hui Xue, Dongguan (CN)

(73) Assignee: TRANSOUND ELECTRONICS CO., LTD., Dongguan (CN)

( * ) Notice: Subject to any disclaimer, the term of this patent is extended or adjusted under 35 U.S.C. 154(b) by 0 days.

(21) Appl. No.: 17/153,854

(22) Filed: Jan. 20, 2021

(65) Prior Publication Data

US 2022/0150611 A1 May 12, 2022

(30) Foreign Application Priority Data

Nov. 11, 2020 (CN) ..... 202022595802.5

(51) Int. Cl.

| | |
|---|---|
| ***H04R 1/02*** | (2006.01) |
| ***H04R 9/06*** | (2006.01) |
| ***H04R 9/04*** | (2006.01) |
| ***H04R 9/02*** | (2006.01) |
| ***H04R 7/18*** | (2006.01) |
| ***H04R 1/34*** | (2006.01) |
| ***H04R 3/00*** | (2006.01) |
| ***H04R 7/12*** | (2006.01) |

(52) U.S. Cl.

CPC ..... *H04R 1/025* (2013.01); *H04R 1/345* (2013.01); *H04R 3/00* (2013.01); *H04R 7/127* (2013.01); *H04R 7/18* (2013.01); *H04R 9/025* (2013.01); *H04R 9/045* (2013.01); *H04R 9/06* (2013.01); *H04R 2400/11* (2013.01)

(58) Field of Classification Search

CPC ..... H04R 1/025; H04R 1/345; H04R 3/00; H04R 7/127; H04R 7/18; H04R 9/025; H04R 9/045; H04R 9/06; H04R 2400/11

USPC ..... 381/332

See application file for complete search history.

(56) References Cited

U.S. PATENT DOCUMENTS

| | | | | |
|---|---|---|---|---|
| 2016/0330549 | A1* | 11/2016 | Yuen | H04R 7/125 |
| 2019/0238992 | A1* | 8/2019 | Seo | H04R 9/025 |
| 2019/0281374 | A1* | 9/2019 | Proni | H04R 9/02 |
| 2019/0335277 | A1* | 10/2019 | Xie | H04R 9/025 |
| 2019/0335278 | A1* | 10/2019 | Gong | H04R 7/18 |

* cited by examiner

*Primary Examiner* — Sean H Nguyen
(74) *Attorney, Agent, or Firm* — Leong C. Lei

(57) ABSTRACT

A one-piece speaker having a built-in sound cavity includes a holder, a casing, a diaphragm, a voice coil, a washer, a magnet, a U-shaped cup, and a circuit board assembly. The speaker has its built-in sound cavity, so that the assembly is more convenient and flexible. The overall structure is simpler and easy to be produced. The sound cavity is larger, the sound sensitivity is better, and there is no need to distinguish between mid and low sounds. The bandwidth is larger, the response speed is faster, the signal frequency allowed to pass is high, the signal distortion is small, and the sound quality is better.

9 Claims, 7 Drawing Sheets

ONE-PIECE SPEAKER HAVING BUILT-IN SOUND CAVITY

BACKGROUND OF THE INVENTION

1. Field of the Invention

The present invention relates to a speaker, and more particularly to a one-piece speaker having a built-in sound cavity.

2. Description of the Prior Art

A conventional speaker generally includes a holder, a U-shaped cup and a diaphragm installed on the holder, a magnet and a washer installed in the U-shaped cup to form a magnetic gap, and a voice coil installed on the diaphragm. The voice coil extends to the magnetic gap. A wire is electrically connected to the voice coil, enabling the voice coil to vibrate the diaphragm to produce sounds.

When electronic product manufacturers purchase this speaker to install in a corresponding product, it is necessary to design and adjust the sound cavity. This increases design and installation costs and also limits design flexibility. For example, in an earphone, the conventional speaker is mounted in the cavity of the earphone to form a rear sound cavity. Because the volume and shape of the rear sound cavity are related to the sound effect, the sound effect of the earphone should be considered when installing this kind of speaker to the earphone. Therefore, it is necessary to design the shape and structure of the cavity of the earphone and the installation structure of the speaker in the cavity of the earphone, resulting in high design workload and design cost of electronic products and limited design flexibility. The installation of the speaker is not flexible and easy, and the adjustment of the sound effect is troublesome. There are some speakers with a built-in sound cavity on the market. However, they have problems, for example, the sound cavity is small, the sound sensitivity is not good, the bandwidth is small, the response speed is slow, the signal frequency allowed to pass is low, the signal distortion is large, the sound quality is poor, etc.

Accordingly, the inventor of the present invention has devoted himself based on his many years of practical experiences to solve these problems.

SUMMARY OF THE INVENTION

In view of shortcomings of the prior art, the primary object of the present invention is to provide a one-piece speaker having a built-in sound cavity. It solves the problems of the prior art, for example, the installation of the conventional speaker is not flexible and simple, the adjustment of the sound effect is troublesome, the sound cavity is small, the sound sensitivity is not good, the bandwidth is small, the response speed is slow, the signal frequency allowed to pass is low, the signal distortion is large, the sound quality is poor, etc.

In order to achieve the above object, the present invention adopts the following technical solutions.

A one-piece speaker comprises a holder, a casing, a diaphragm, a voice coil, a washer, a magnet, a U-shaped cup, and a circuit board assembly. The casing covers the holder. The diaphragm and the circuit board assembly are attached to a front and a back of the holder, respectively. The U-shaped cup is mounted to the holder and extends out of the circuit board assembly. The magnet is disposed in the U-shaped cup. The washer is stacked on the magnet. The voice coil is mounted on the diaphragm and extends between the magnet and the U-shaped cup. A sound cavity located behind the diaphragm is formed between the circuit board assembly and the holder.

Compared with the prior art, the present invention has obvious advantages and beneficial effects. Specifically, it can be seen from the above technical solution that the holder is mounted to the casing, the back of the holder is provided with the circuit board assembly, and the sound cavity is formed between the circuit board assembly and the holder, so as to achieve a one-piece design of the speaker. The speaker has its built-in sound cavity. Thus, when the speaker is applied to an earphone, there is no need to adjust the sound effect of the speaker, thereby reducing the workload and making the assembly more convenient and flexible. The overall structure is simpler and easy to be produced. In particular, the sound cavity is formed by covering the circuit board assembly on the holder, so that the space of the holder can be maximized while ensuring the installation of internal components. Thus, the sound cavity is larger, the sound sensitivity is better, and there is no need to distinguish between mid and low sounds. The bandwidth is larger, the response speed is faster, the signal frequency allowed to pass is high, the signal distortion is small, and the sound quality is better.

DETAILED DESCRIPTION OF THE PREFERRED EMBODIMENTS

Figure 1:
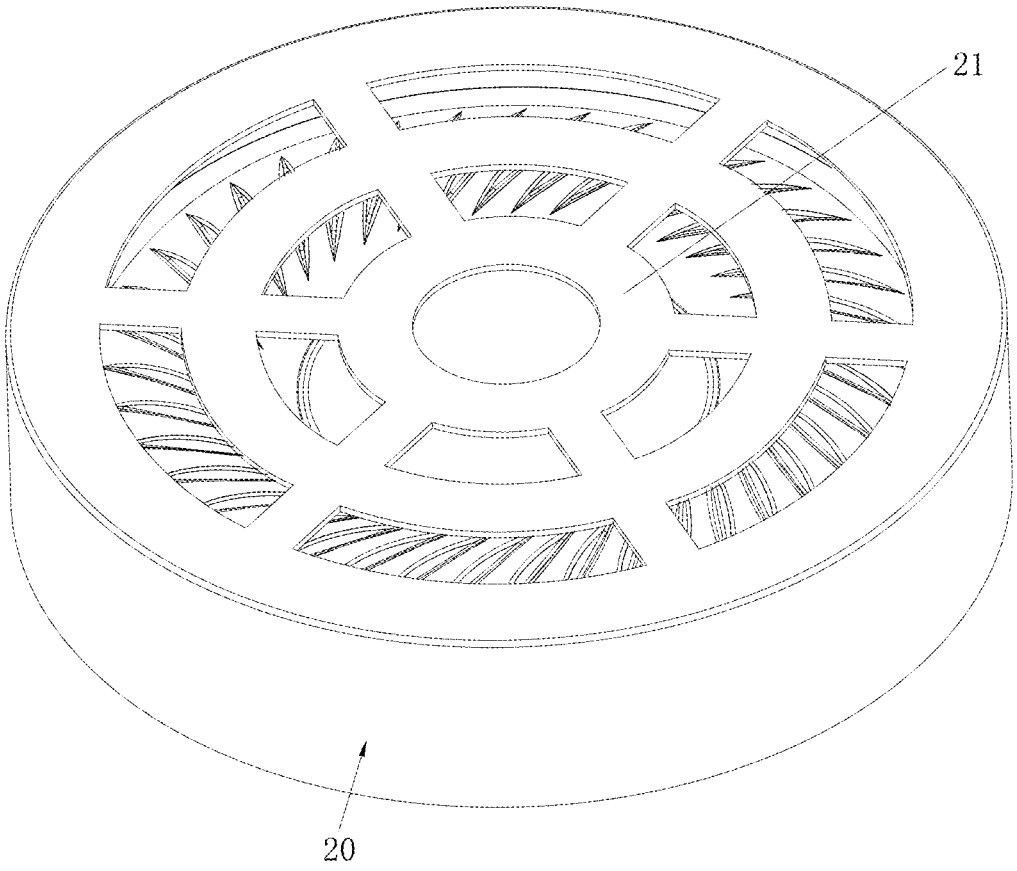
FIG. 1 is a perspective view of the present invention.
Figure 2:
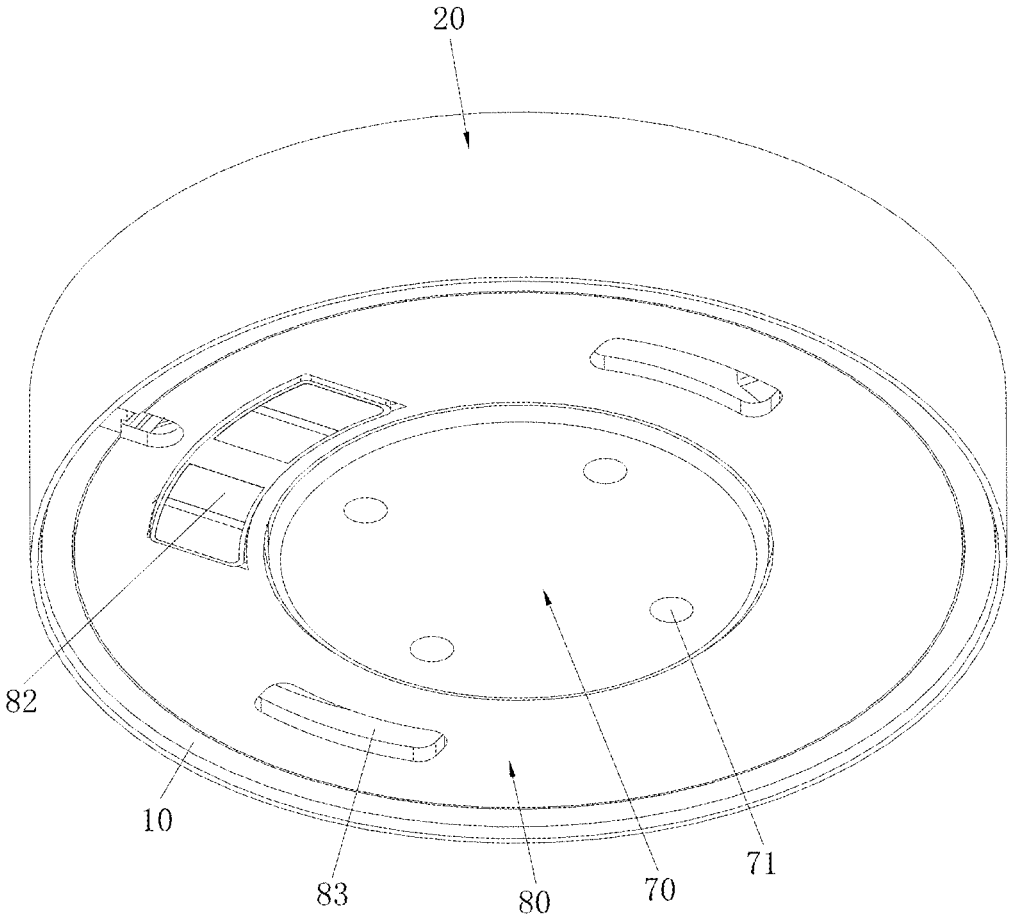
FIG. 2 is another perspective view of the present invention.
Figure 3:
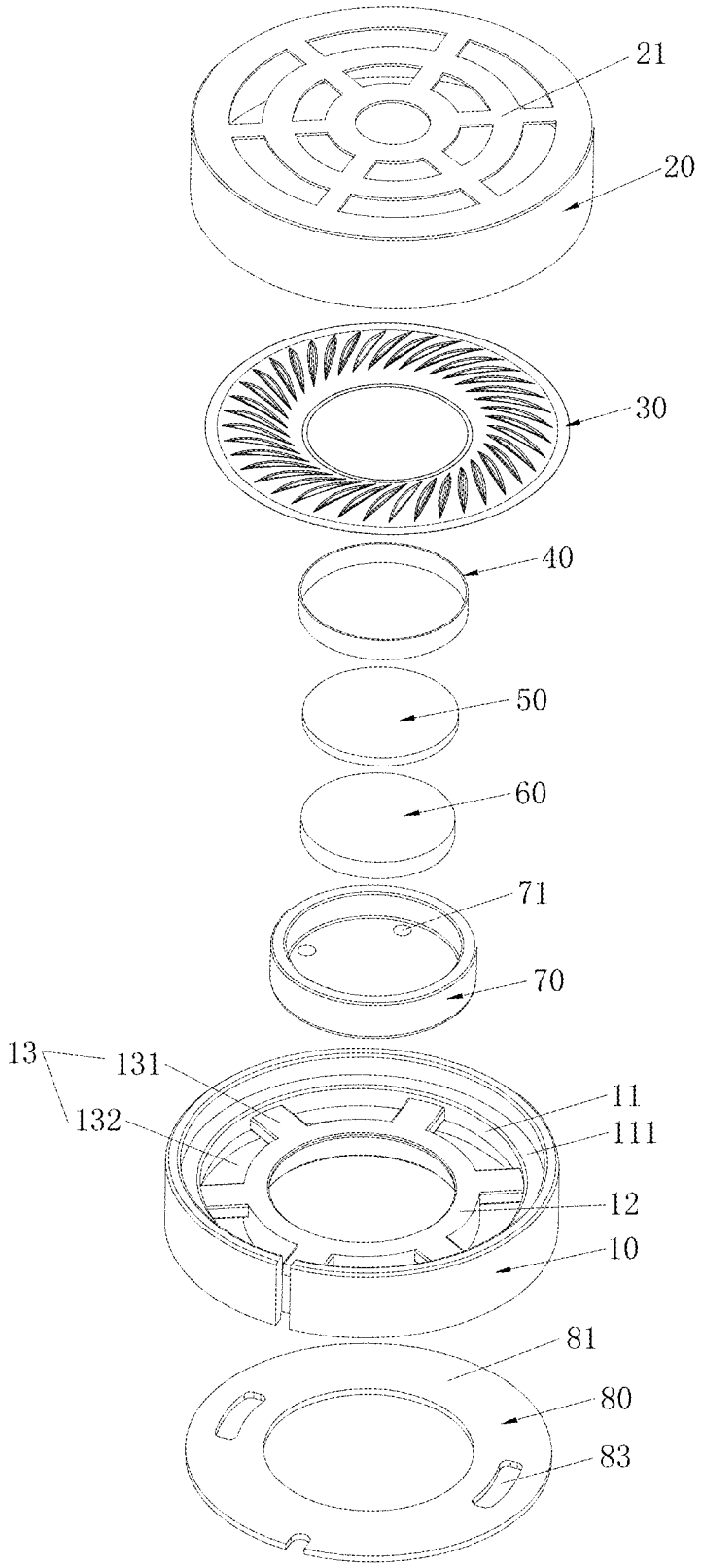
FIG. 3 is an exploded view of the present invention.
Figure 4:
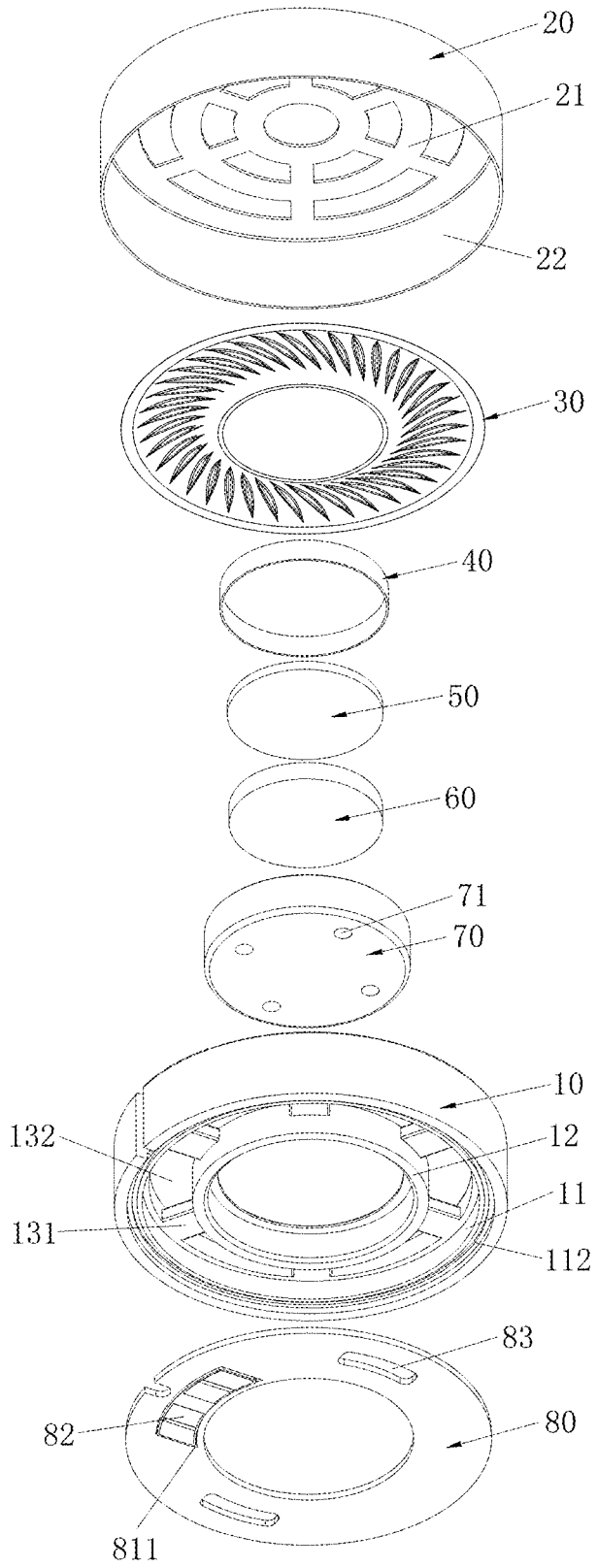
FIG. 4 is another exploded view of the present invention.
Figure 5:
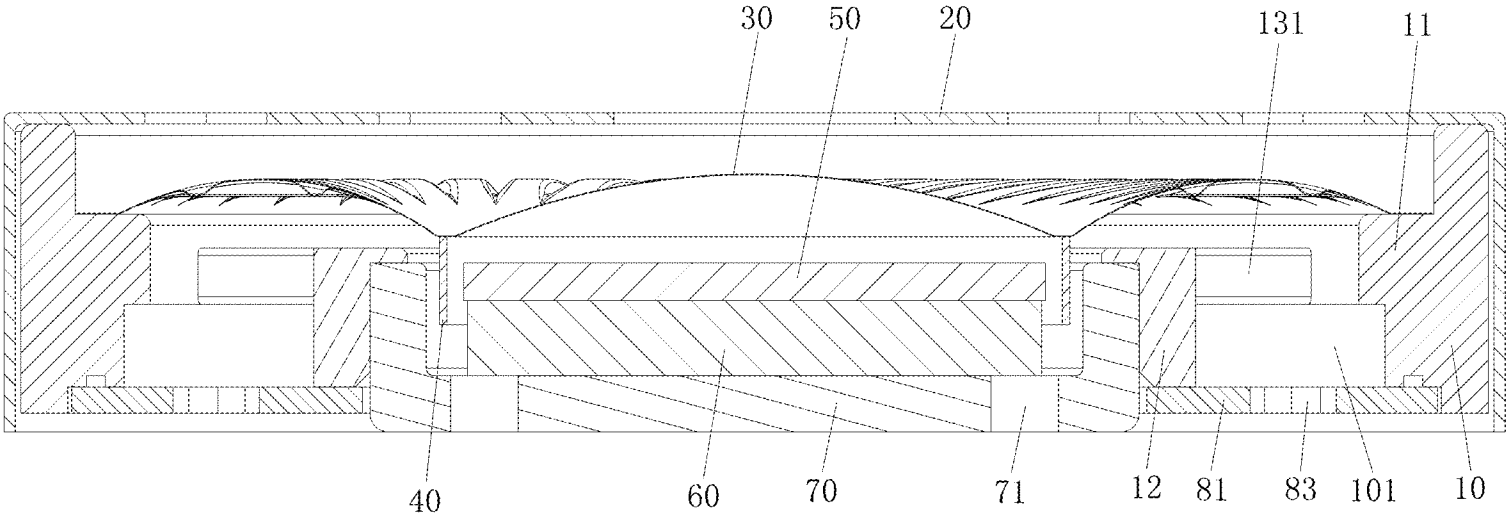
FIG. 5 is a cross-sectional view of the present invention.

Embodiments of the present invention will now be described, by way of example only, with reference to the accompanying drawings.

As shown in FIG. 1 through FIG. 5, the present invention discloses a one-piece speaker having a built-in sound cavity, comprising a holder 10, a casing 20, a diaphragm 30, a voice coil 40, a washer 50, a magnet 60, a U-shaped cup 70, and a circuit board assembly 80. The casing 20 covers the holder 10. The diaphragm 30 and the circuit board assembly 80 are attached to the front and back of the holder 10, respectively. The U-shaped cup 70 is mounted to the holder 10 and extends out of the circuit board assembly 80. The magnet 60 is disposed in the U-shaped cup 70. The washer 50 is stacked on the magnet 60. The voice coil 40 is mounted on the diaphragm 30 and extends between the magnet 60 and the U-shaped cup 70. A sound cavity 101 located behind the diaphragm 30 is formed between the circuit board assembly 80 and the holder 10. Thus, the one-piece design of the speaker is realized, and the speaker has its built-in sound cavity. In this way, the sound effect can be adjusted on the basis of the built-in sound cavity when the speaker leaves the factory. For manufacturers who subsequently purchase electronic products, such as earphones, after purchasing such a speaker with a built-in sound cavity, it can be directly assembled in the housing of an earphone without adjusting the sound effect of the speaker. Only the speaker needs to be mounted to the housing of the earphone, without considering the size and structure of the sound cavity. This reduces the design workload and design cost.

Figure 6:
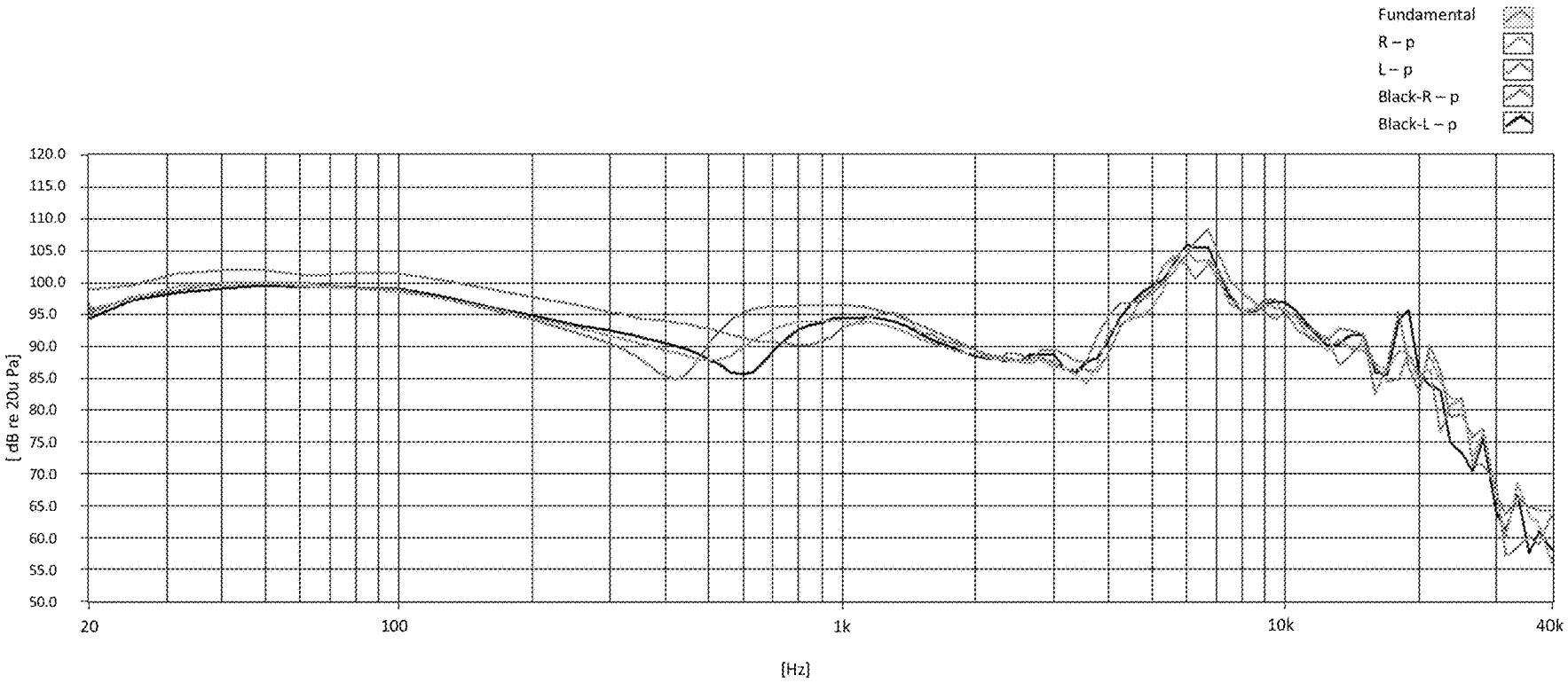
FIG. 6 (PRIOR ART)
FIG. 6 is a frequency response curve diagram of a conventional speaker.
Figure 7:
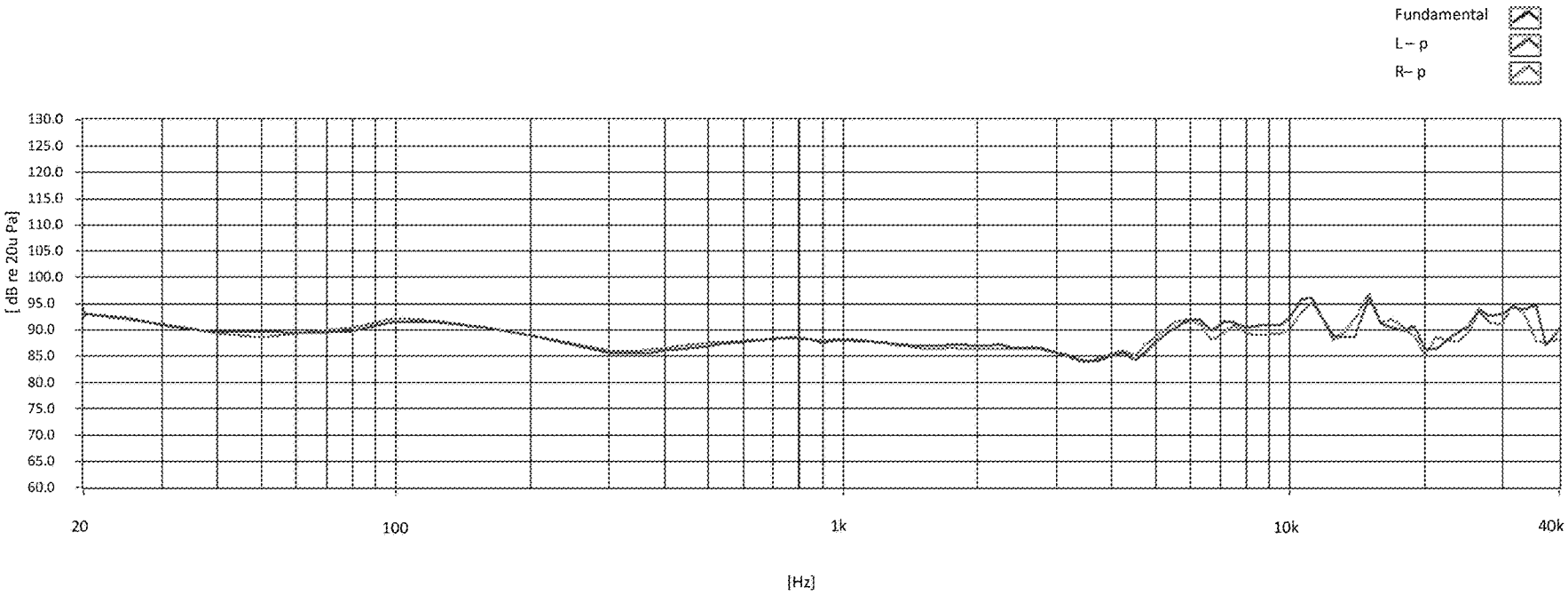
FIG. 7 is a frequency response curve diagram of an embodiment of the present invention.

Specifically, the holder 10 has two open ends. The inner side wall of the holder 10 has an annular positioning portion 11. The front and rear sides of the annular positioning portion 11 are formed with a first mounting seat 111 and a second mounting seat 112, respectively. The diaphragm 30 and the circuit board assembly 80 are mounted to the first mounting seat 111 and the second mounting seat 112, respectively. An annular mounting portion 12 is connected to the inner side wall of the annular positioning portion 11. The U-shaped cup 70 is mounted to the annular mounting portion 12. The circuit board assembly 80 is attached to the rear side of the annular mounting portion 12. A first hollowed-out portion 13 is provided between the annular mounting portion 12 and the annular positioning portion 11. The sound cavity 101 is formed among the circuit board assembly 80, the holder 10, the annular mounting portion 12 and the first hollowed-out portion 13. The first hollowed-out portion 13 communicates with the sound cavity 101. The first hollowed-out portion 13 includes a plurality of connecting arms 131. Two ends of each connecting arm 131 are connected to the outer side wall of the annular mounting portion 12 and the inner side wall of the annular positioning portion 11, respectively. A through hole 132 is formed between every adjacent two of the connecting arms 131. The through hole 132 communicates with the sound cavity 101. The frequency response curves shown in FIG. 6 and FIG. 7 are obtained by testing with an artificial mouth at a voltage of 0.178V. FIG. 6 is a diagram of the frequency response curve obtained by collecting two pairs of conventional earphones. FIG. 7 is a diagram of the frequency response curve obtained when this embodiment is applied to an earphone. The vertical axis is the sensitivity, and the value range of the sensitivity is 50-120 dB. The horizontal axis is the bandwidth, and the value range of the bandwidth is 20 Hz-40 kHz. L represents a left earphone. R represents a right earphone. As shown in FIG. 6 and FIG. 7, compared with the frequency response curve of the conventional speaker shown in FIG. 6, it can be seen that the frequency response curve of the embodiment shown in FIG. 7 has a wider bandwidth at 10-40K. Thus, through the combined design of the through hole 132 of the first hollowed-out portion 13 and the sound cavity 101, the sound cavity 101 formed between the holder 10 and the circuit board assembly 80 is larger, the sound sensitivity is better, and there is no need to distinguish between mid and low sounds. The bandwidth is larger, the response speed is faster, the signal frequency allowed to pass is high, the signal distortion is small, and the sound quality is better.

In this embodiment, the first mounting seat 111 and the second mounting seat 112 are a first annular limit surface and a second annular limit surface, respectively. The diaphragm 30 and the circuit board assembly 80 are attached to the first annular limit surface and the second annular limit surface, respectively. The diaphragm 30 and the circuit board assembly 80 are preferably attached to the first annular limit surface and the second annular limit surface by gluing, so that the structure is simpler and the internal space is larger. The circuit board assembly 80 has a first sound guide hole 83 passing through the front and rear sides of the circuit board assembly 80. The first sound guide hole 83 communicates with the sound cavity 101. The bottom of the U-shaped cup 70 has a second sound guide hole 71 passing through the inner and outer sides of the U-shaped cup 70. Thus, the arrangement of the first sound guide hole 83 and the second sound guide hole 71 facilitates the sound guide and adjustment of the speaker.

The front side of the casing 20 has a second hollowed-out portion 21. The second hollowed-out portion 21 covers the front side of the casing 20. The rear side of the casing 20 has an opening. The casing 20 has a mounting space 22. The second hollowed-out portion 21 communicates with the mounting space 22. The holder 10 is mounted in the mounting space 22. The diaphragm 30 is disposed toward the second hollowed-out portion 21. The circuit board assembly 80 is disposed toward the opening. Thus, the arrangement of the second hollowed-out portion 21 can ensure the sound guide of the speaker and the stability of the overall structure.

Furthermore, in this embodiment, the circuit board assembly 80 includes a cover plate 81 and a printed circuit board 82 installed on the rear side of the cover plate 81. The cover plate 81 covers the back of the holder 10. The U-shaped cup 70 extends out of the cover plate 81. The sound cavity 101 is formed among the cover plate 81, the holder 10, the annular mounting portion 12, and the first hollowed-out portion 13. The rear side of the cover plate 81 is formed with a recess 811 for limiting the printed circuit board 82. The printed circuit board 82 is attached to the rear side of the cover plate 81 and limited by the recess 811. The front side of the cover plate 81 is attached to the second annular limit surface. The first sound guide hole 83 is formed on the cover plate 81. The first sound guide hole 83 is an annular sound guide hole. The front side of the cover 81 is attached to the rear side of the annular mounting portion 12. Preferably, the cover plate 81 is an annular cover plate 81. The front side of the annular cover plate 81 is attached to the back of the holder 10 (that is, the second annular limit surface). The rear side of the U-shaped cup 70 extends out of the annular cover plate 81. Thus, designing the cover plate 81 as an annular cover 81 and installing the printed circuit board 82 on the rear side of the annular cover plate 81 can simplify the overall structure of the circuit board assembly 80, so as to simplify the manufacturing process and to facilitate the assembly of the cover plate 81.

What is claimed is:

1. A one-piece speaker, comprising a holder, a casing, a diaphragm, a voice coil, a washer, a magnet, a U-shaped cup, and a circuit board assembly; the casing covering the holder, the diaphragm and the circuit board assembly being attached to a front and a back of the holder respectively, the U-shaped cup being mounted to the holder and extending out of the circuit board assembly, the magnet being disposed in the U-shaped cup, the washer being stacked on the magnet, the voice coil being mounted on the diaphragm and extends between the magnet and the U-shaped cup, a sound cavity located behind the diaphragm being formed between the circuit board assembly and the holder; wherein the holder has two open ends, an inner side wall of the holder has an annular positioning portion, front and rear sides of the annular positioning portion are formed with a first mounting seat and a second mounting seat respectively, the diaphragm and the circuit board assembly are mounted to the first mounting seat and the second mounting seat respectively, an annular mounting portion is connected to an inner side wall of the annular positioning portion, the U-shaped cup is mounted to the annular mounting portion, the circuit board assembly is attached to a rear side of the annular mounting portion, a first hollowed-out portion is provided between the annular mounting portion and the annular positioning portion, the sound cavity is formed among the circuit board assembly, the holder, the annular mounting portion and the first hollowed-out portion, and the first hollowed-out portion communicates with the sound cavity.

2. The one-piece speaker as claimed in claim 1, wherein the first mounting seat and the second mounting seat are a first annular limit surface and a second annular limit surface respectively, and the diaphragm and the circuit board assembly are attached to the first annular limit surface and the second annular limit surface, respectively.

3. The one-piece speaker as claimed in claim 1, wherein the first hollowed-out portion includes a plurality of connecting arms, two ends of each connecting arm are connected to an outer side wall of the annular mounting portion and the inner side wall of the annular positioning portion respectively, a through hole is formed between every adjacent two of the connecting arms, and the through hole communicates with the sound cavity.

4. The one-piece speaker as claimed in claim 1, wherein the circuit board assembly has a first sound guide hole passing through front and rear sides of the circuit board assembly, and the first sound guide hole communicates with the sound cavity.

5. The one-piece speaker as claimed in claim 1, wherein a bottom of the U-shaped cup has a second sound guide hole passing through inner and outer sides of the U-shaped cup.

6. The one-piece speaker as claimed in claim 1, wherein a front side of the casing has a second hollowed-out portion, the second hollowed-out portion covers the front side of the casing, a rear side of the casing has an opening, the casing has a mounting space, the second hollowed-out portion communicates with the mounting space, the holder is mounted in the mounting space, the diaphragm is disposed toward the second hollowed-out portion, and the circuit board assembly is disposed toward the opening.

7. The one-piece speaker as claimed in claim 1, wherein the circuit board assembly includes a cover plate and a printed circuit board installed on a rear side of the cover plate, the cover plate covers the back of the holder, and the U-shaped cup extends out of the cover plate.

8. The one-piece speaker as claimed in claim 7, wherein the cover plate is an annular cover plate, a front side of the annular cover plate is attached to the back of the holder, and a rear side of the U-shaped cup extends out of the annular cover plate.

9. The one-piece speaker as claimed in claim 7, wherein the rear side of the cover plate is formed with a recess for limiting the printed circuit board, and the printed circuit board is attached to the rear side of the cover plate and limited by the recess.

* * * * *